US005316496A

United States Patent [19]

Imai

[11] Patent Number: 5,316,496

[45] Date of Patent: May 31, 1994

[54] CONNECTOR FOR FLAT CABLES

[75] Inventor: Akira Imai, Yokohama, Japan

[73] Assignee: The Whitaker Corporation, Wilmington, Del.

[21] Appl. No.: 21,916

[22] Filed: Feb. 24, 1993

[30] Foreign Application Priority Data

Feb. 28, 1992 [JP] Japan ..... 4-018201
Mar. 23, 1992 [JP] Japan ..... 4-023928

[51] Int. Cl.[5] ..... H01R 13/00
[52] U.S. Cl. ..... 439/495; 439/630
[58] Field of Search ..... 439/629-637, 439/492, 493, 495, 499

[56] References Cited

U.S. PATENT DOCUMENTS 3,893,745 7/1975 Codrino ..... 439/495
4,519,133 5/1985 Pasanel ..... 439/495
4,542,950 9/1985 Gillett et al. ..... 439/630
4,721,348 1/1988 Mouissie ..... 439/630

*Primary Examiner*—Joseph H. McGlynn
*Attorney, Agent, or Firm*—Timothy J. Aberle

[57] ABSTRACT

An electrical connector having multiple pairs of penetrating first apertures (23) and second apertures (24) which are longitudinally formed from bottom (21) to top (22) of insulated connector housing (20), and a cable insertion aperture (25) connects with first aperture (23) and is formed in top (22). Each contact (40) has a beam-shaped contact unit (44) and a holder (46) projecting upward from base (43), and a solder tine (48) extending downward from the base (43). A contact point (45) elastically projects into cable insertion aperture (25). A probe for continuity checking can access contact (40) holder (46) from second aperture (24).

14 Claims, 4 Drawing Sheets

CONNECTOR FOR FLAT CABLES

This invention relates to an electrical connector; in particular, to a flat connector which has multiple contacts connected to the end of a flexible flat cable (FFC).

BACKGROUND OF THE INVENTION

FFCs have superior utility and operability because they arrange multiple leads densely and are very flexible; consequently, they are widely used in small electronic devices such as CD players, video cameras, and small business (office) devices such as copiers and fax machines.

Japanese Utility Model 3-22869 and Japanese Patent Application 59-23482, for example, disclose conventional connectors for FFCs. Such conventional FFC connectors generally include hook-shaped contacts or a single beam-shaped contact and the FFC end is overlapped with a slider's insulated tongue inside an insulated housing and is thereby connected and secured.

However, such conventional FFC connectors inevitably are large due to the contact shape and use of a slider, so that it is impossible or extremely difficult for them to meet the demand for miniaturization in the latest electronic devices. Also, it is difficult for such conventional FFC connectors to adequately handle multiple contacts if there are about 40 contacts, for example. Furthermore, it is hard to do an electrical continuity check on whether or not the FFC leads touching correctly.

Therefore, with the intention of resolving the above-noted defects of conventional FFC connectors, the object of this invention is to present a flat-cable connector that can easily be miniaturized and densely packed, that has superior operability, and provides ease of use for continuity testing.

Prior art FIGS. 9–10 show one conventional example of such an FFC connector 1. FIG. 9 is a top view, FIG. 10 is a cross-section along line B—B, and FIG. 11 shows the end of a commonly known FFC used in FFC connector 1.

Long thin cable insertion groove 3 is formed from the top towards the bottom of FFC connector 1's insulated housing 2, and multiple contact-receiving apertures 4*a*–4*b* are formed along cable insertion groove 3. Furthermore, key 5 is formed by, for example, unitary molding to cross cable insertion groove 3 at a position which is off-center relative to insulated housing 2's cable insertion groove 3. Additionally, as shown in FIG. 10, contacts 6 are pressed into each contact-receiving aperture 4*a*–4*b* from the bottom of insulated housing 2. Contact 6's single-beam contact arm 7 is inserted into aperture 4*a*. Holding arm 8 is inserted into aperture 4*b*, and soldering tine 9 extends downward from insulated housing 2's bottom to the outside insulated housing 2. Tine 9 is inserted into a hole in a circuit board (not shown) and connected by soldering, for example.

The FFC "C" used in conjunction with FFC connector 1 has multiple, flat, parallel leads W which are insulated from each other and are coated and adhered to a plastic base. Additionally, slit S, which has a predetermined width, is formed in the end of cable C to determine the insertion orientation into FFC connector 1's cable insertion groove 3. Slit S aligns with positioning key 5 in FFC connector 1's cable insertion groove 3, and cable C is then pushed into groove 3. Through this pushing, each exposed lead W at the end of FFC C makes electrical contact with contact point 7*a* formed near the tip of each contact 6's contact arm 7.

In such prior FFC connectors, it is difficult to arrange a large enough contact pressure for each contact between FFC C and FFC connector 1 due to FFC C's frictional properties. If the contact pressure is fairly large, the insertion force increases and it becomes difficult to insert FFC C into cable insertion groove 3. On the other hand, if the contact pressure is too small, the electrical contact becomes insecure and there is concern that FFC C could come out of FFC connector 1 with a comparatively small separation force. Therefore, an FFC connector is required which has a low insertion force along with an adequate extraction force so that FFC C is not extracted from FFC connector 1 even if a relatively large separation force is applied.

Therefore, in Japanese Utility Application 3-358045, for such an FFC connector this applicant previously proposed pushing in and securing a separate key plug, formed of an elastic plastic member, into a slot in the insulated housing instead of a bar unitarily molded at both ends to the insulated housing and crossing the cable insertion groove, so that the key plug engages with a non-linear slit formed in the end of the FFC. The key plug and FFC slit do not greatly increase the insertion force, and engagement of the slit's stepped unit increases the extraction force when it is desired to extract the FFC.

However, using a separate key plug in the insulated housing has the disadvantage of increasing the number of parts and the number of assembly processes, so that it results in a complicated design with high cost.

SUMMARY OF THE INVENTION

According to the instant invention's flat-cable connector, multiple pairs of first and second apertures are formed which penetrate from the bottom to the top along the longitudinal direction of the insulated housing, and an FFC insertion aperture connecting to the first apertures is formed from the top toward the bottom. Additionally, nearly flat contacts which have a beam-shaped arm and a holder are pressed into and held in each pair of first and second apertures from the bottom of the insulated housing. Each contact's holder has a narrow, long aperture extending longitudinally, and the contacts have contact points projecting into the cable insertion apertures.

The instant invention further includes an FFC connector which forms a single-beam-shaped key member that is molded in one piece with the insulated housing in a direction which crosses the insulated housing's cable insertion aperture. Additionally, the key member is formed with a tapered engaging side, for example, and engages with the FFC slit's non-linear side wall or stepped unit and thereby increases the FFC extraction force.

In an embodiment of the invention, the FFC slit is formed non-symmetrically, and one end of the FCC connector's insulated housing's key member is secured in the side wall of the cable insertion groove and the free end is formed in a single beam shape projecting inside the cable insertion groove. Also, in another embodiment of the invention, the FFC slit is formed almost symmetrically, and one end of the key member is formed into a single-beam shape secured in the bottom of the insulated housing's cable insertion groove.

BRIEF DESCRIPTION OF THE DRAWINGS

FIG. 8 is a view showing an FFC connector according to another embodiment of the instant invention and an FFC used in that.

DESCRIPTION OF THE PREFERRED EMBODIMENTS

Figure 1:
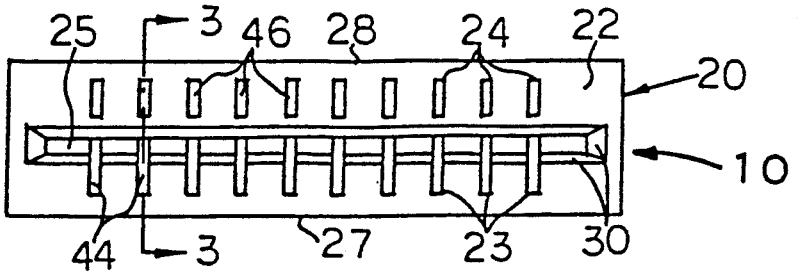
FIG. 1 is a top view of an embodiment of a flat-cable connector according to the instant invention.
Figure 2:
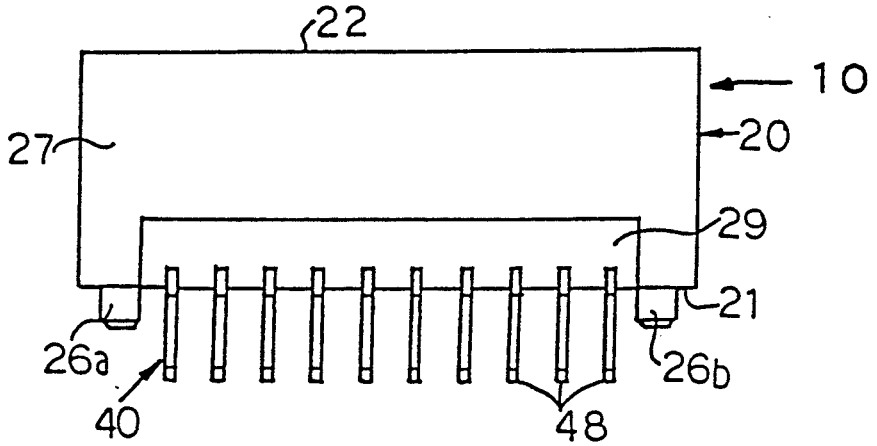
FIG. 2 is a front view of the connector shown in FIG. 1.
Figure 3:
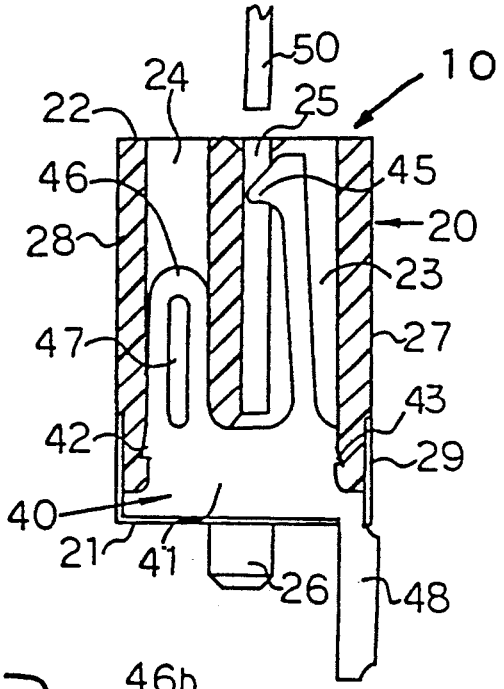
FIG. 3 is a cross-sectional view of the flat-cable connector along line 3—3 in FIG. 1.

FIGS. 1-3 show an upper view, front view, and cross-sectional view, respectively, of an embodiment of a flat-cable connector according to the instant invention. The case shown in FIGS. 1-3 has 10 contacts, but this is merely an example. Of course, the number of contacts can be increased or decreased at will, depending on need or usage.

Flat-cable connector 10 (hereafter referred to as FFC connector 10) is generally composed of multiple contacts 40 and insulated housing 20, which is long, slender, nearly rectangular, and made of plastic. Insulated housing 20 has multiple (10 in this specific embodiment) pairs of first apertures 23 and second apertures 24 penetrating from bottom 21 to top 22 and longitudinally formed at fixed intervals (for example, a pitch of 1.25 mm). Also, a narrow, long cable insertion aperture 25, which connects with first aperture 23, is formed from insulated housing 20's top 22 toward bottom 21. A pair of round, column-shaped projections 26*a*, 26*b* for determining position are formed near both ends of insulated housing 20's bottom 21. Furthermore, notch 29 is near the bottom of both sides 27 and 28 of insulated housing 20, which housing is formed so that it narrows the side wall thickness of insulated housing 20, for reasons to be described later.

As shown best in FIG. 1, a taper 30 is formed in the top of cable insertion aperture 25 which creates a guide for the FFC end and makes the insertion operation easy. Additionally, as shown best in FIG. 3, first aperture 23 and second aperture 24 correspond to the thickness of contacts (to be described below) and are formed to penetrate from insulated housing 20's bottom 21 to top 22.

FIG. 3 is a cross-section along line 3—3 in FIG. 1. Each contact 40 is made up of a base 41 which has barbs 42 and 43 formed at both ends; a contact unit 44 and a holder 46, which are beam-shaped and extend upward from near both ends of the top of the base 41; and a solder tine 48, which extends downward from one end of base 41's bottom. Under normal conditions, contact unit 44 slants to the left side in the diagram and its tip has hook-shaped contact point 45, which projects inside insulted housing 20's cable insertion aperture 25. Holder 46 is formed with a long aperture 47 running almost its entire length in the longitudinal direction.

Figure 4:
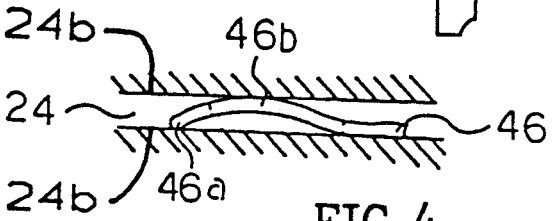
FIG. 4 is a cross-sectional view showing the engagement of FIG. 3's electrical contact and insulated housing.

Furthermore, as shown in FIG. 4, contact 40's holder 46 can be bent in almost a U-shape along its entire length so that near its base 41 and tip 46*a* it engages one of aperture 24's inside walls 24*a*; and its central bend 46*b* engages the other inside wall 24*b*. By structuring contact 40 in this way, contact 40 is securely fixed in second aperture 24*a* by base 41's barbs 42 and 43 and by holder 46. There is a concern that insulated housing 20's side walls 27 and 28 will bulge outwardly because of barbs 42 and 43 pushing of the wall material at both ends of contact 40's base 41. But, as described above, notch 29 is formed on the outer surface of insulated housing 20's side walls 27 and 28, so the outer surfaces of side walls 27 and 28 do not protrude outwardly. Additionally, making this part of insulated housing 20 thinner or notched ensures a good insertion operation for contact 20 and ensures a good friction engagement with barbs 42 and 43.

In this specific embodiment of the invention insulated housing 20's dimensions are a height of about 6.0 mm and a depth (or thickness) of 4.0 cm. Width depends on contact 40's pitch and number of contacts.

Furthermore, FIG. 3 shows FFC 50's end being inserted into insulated housing 20's cable insertion aperture 25. Contact 40's beam-shaped contact unit 44's contact point 45 has an inclined hook shape on its upper surface, so when FFC 50 is inserted, contact unit 44 bends outward (to the right) and it is possible to insert FFC 50's tip. However, once it has been inserted, FFC 50 is held by the hook structure of contact point 45, and contact point 45 and FFC 50's lead (not shown) are maintained in an electrically and mechanically engaged state unless a relatively large tension is applied.

Furthermore, first aperture 23 and second aperture 24 both penetrate to insulated housing 20's top 22, so contact 40's insertion status can easily be confirmed from above. Additionally, one can insert a probe that has a pointed electrode from insulated housing 20's top 22 into second aperture 24 for a continuity check. Because of this continuity check function, the upper part of second aperture 24 might be made a little larger than the lower part to improve the probe insertion operability.

A suitable embodiment of this invention's FFC connector was described in detail above, but the instant invention is in no way limited to this specific embodiment; it is understood that it can undergo various changes as needed. For example, each contact 40 might have an SMT (surface mounting) tine instead of solder tine 48. Additionally, adjacent contact tines might be alternately arranged on opposite sides of the insulated housing in a staggered pattern. Each contact 40's holder 46 could extend through second aperture 24 to near insulated housing 20's top 22 or could partially project through the top. Furthermore, if necessary, a slit could be formed in insulated housing 20's position-determining projection, as disclosed in Japanese Utility Application 3-100367, and a separate flat elastic metal holder fitting could be incorporated into it. Or instead of position-determining projection 26, separate elastic metal securing units could be pushed into and secured in apertures near both ends of the insulating housing, as is disclosed in Japanese Utility Model 42645.

In a second embodiment, connector 10 has a long, thin, nearly rectangular insulated housing 20'. Long thin cable insertion groove 22' is formed on top 21' of insulated housing 20' and extends along the longitudinal direction and tower the bottom. A taper is formed in the top of cable insertion groove 22'. Multiple contact-receiving apertures 23'-24' are formed in pairs along and on both sides of cable insertion groove 22' and they penetrate from top 21' to the bottom. Contact arms and holder arms (described below) are pressed into and held in these contact-receiving apertures 23'-24' from the bottom. As shown in the diagram, aperture 23' connects to cable insertion groove 22' and is arranged so that the contact point on the end of the contact's contact arm projects into cable insertion groove 22'. The number and pitch of adjacent contact-receiving apertures 23'-24' is determined by the number and pitch of leads in the FFC used.

Figure 6:
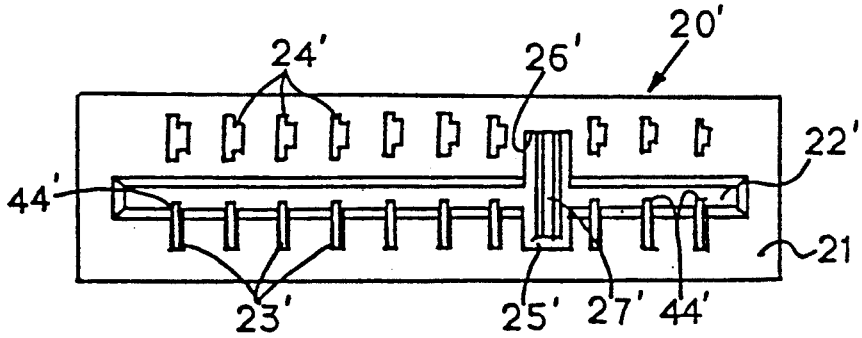
FIG. 6 is a top view of the connector shown in FIG. 5.

Additionally, notch or groove 25, is formed in insulated housing 20' to cross, or transect, and connect with cable insertion groove 22' at a position off-center in the longitudinal direction of cable insertion groove 22'. For example, as shown in FIG. 6, it is to the right. Single-beam-shaped key member 27' is formed of the same material as insulated housing 20' and is preferably unitarily molded. It is secured to one side wall 26' of notch or groove 25', and points toward the opposite side wall, and is positioned a little below top 21' of insulated housing 20'. Taper 28' is formed on the top and both sides of key member 27', and engaging unit 29' is formed on its bottom to engage with the FFC slot side walls to be described later. If key member 27' is formed in insulated housing 20' in this manner, key member 27' has cantilever flexibility in a direction along cable insertion groove 22'.

Figure 5:
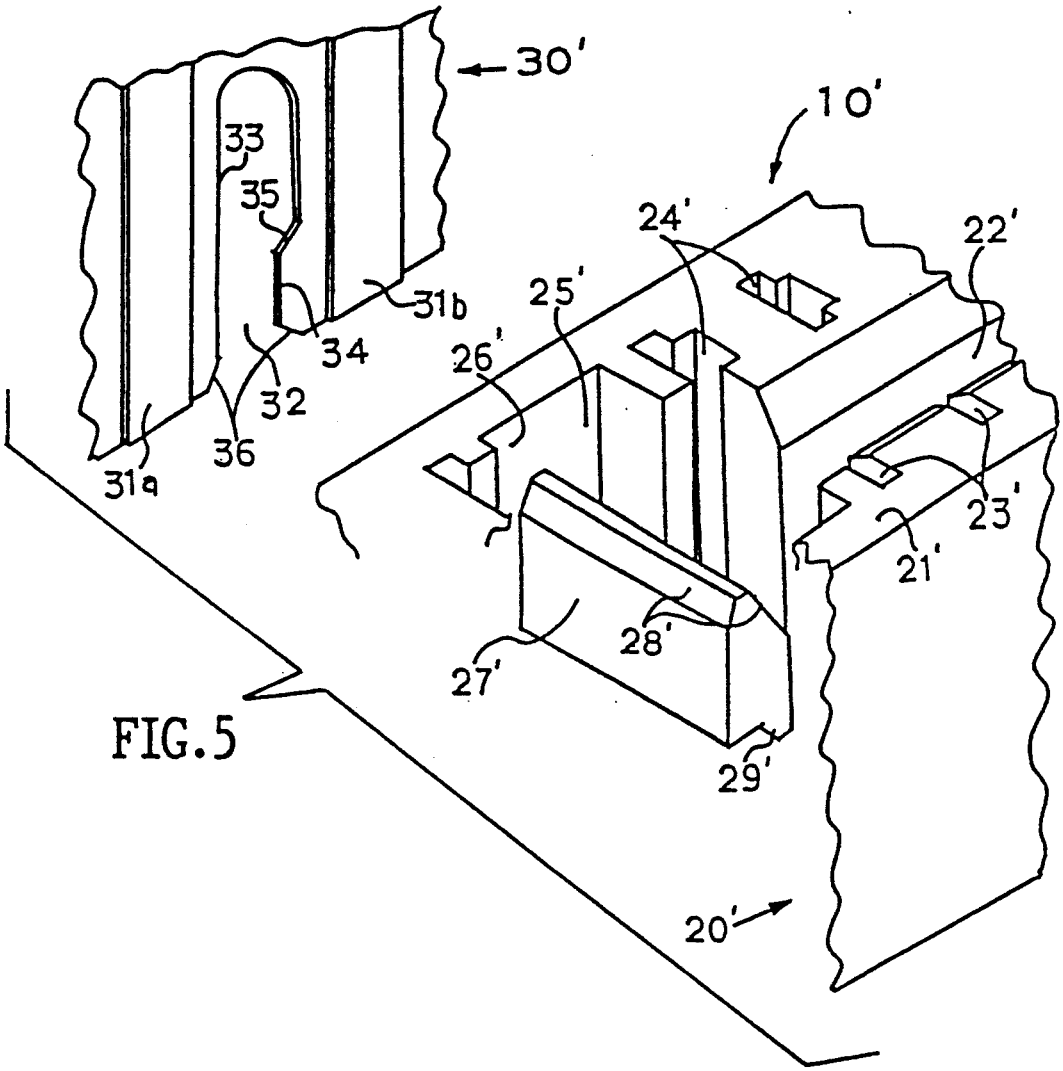
FIG. 5 is an oblique view showing an FFC connector according to another embodiment of the instant invention and an FFC used therewith.

The end of FFC 30', which is inserted and used in FFC connector 10', exposes multiple flat leads 31*a*, 31*b* as shown in the partially magnified and oblique view in FIG. 5. Additionally, slit 32, which is not laterally symmetrical, is formed between leads 31*a* and 31*b*. That is, slit 32's one side wall 33 is almost linear, but the other side wall 34 is a non-linear, stepped unit 35 which has a taper, and is formed near the end. Furthermore, taper 36 is formed at both sides of slit 32's entrance.

Figure 7:
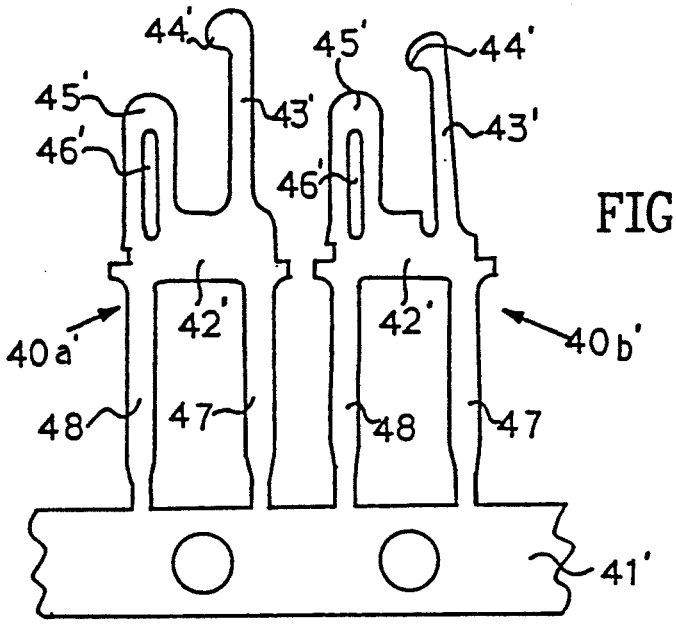
FIG. 7 is a front view showing one example of a contact used in the FFC connector in FIG. 5.

FIG. 7 shows one side of contact 40', which is inserted and held in contact-receiving apertures 23'-34' in insulated housing 20' of FIG. 1's FFC connector 10'. As shown in FIG. 7, the contacts are formed by cutting out an elastic metal sheet that has a prescribed thickness, and alternately positioning and mounting one end of tall contact 40'*a* and short contact 40'*b* on carrier strip 41'. For simplicity, FIG. 7 shows only one pair. Both contacts 40'*a* and 40'*b* are equipped with contact arm 43', which extends upward from the upper right side of base 42' and has contact point 44' at the end, and holding arm 45', which extends upward from the left side and has long thin aperture 46' in its center. Additionally, contacts 40'*a* and 40'*b* have a pair of solder tines 47' and 48' extending downward from the left and right sides of base 42'; if necessary, either of them can be eliminated for a staggered arrangement.

As described above, the contacts 40'*a* and 40'*b* are pressed in from the bottom of insulated housing 20' so that contact arm 43' and holding arm 45' thereby enter contact-receiving apertures 23'-24'. Alternately pushing tall or short contacts 40'*a* and 40'*b* into adjacent positions in contact-receiving apertures 23'-24' alternately offsets the distance top 21' to contact point 44', and in this way the insertion force for FFC 30' is reduced even more.

An explanation of the operation of inserting the end of FFC 30' into FFC connector 10' designed as described above is now in order. First, when inserting the end of FFC 30' into cable insertion groove 22' in insulated housing 20', slit 32' is positioned to face so that it matches the key member 27' of cable insertion groove 22'. Next, FFC 30' is pushed into cable insertion groove 22' a little, and the slit 32' of FFC 30' FFC 30's slit has a taper 36 which makes contact with taper 28' on key member 27'. When pushed in more, key member 27' is bent or resiliently deflected to the left by slit 32's right side wall 34's outcropping. Next the FFC 30' has leads 31*a*, 31*b* which make contact with point 44' on tall contact 40'*a*. When it advances farther, the contact point 44' makes contact with leads 31'*a*, 41'*b*. Finally, the neck of slit 32 passes key member 27', which was bent or deflected to the left, then returns to the normal, undeflected position, and its engaging unit 29 engages with stepped unit 35, which is slanted on slit 32's side wall 34. Through this engagement, FFC 20' is securely held in cable insertion groove 22' even if a relatively large tension operates on FFC 30'.

When releasing the engagement of FFC 30' and FFC connector 20', a sufficiently large tension is applied to FFC 30'. When doing so, slit 32's side wall 34's stepped unit 35 bends or resiliently deflects key member 29' to the left, and in the reverse of what was described above, contact point 44' and FFC 30' leads 31'*a*, 31'*b* separate from the contact and FFC 30' is extracted from FFC connector 10'. At this time, key member 27' reverts to its original position due to its innate elasticity or resiliency. The extraction force here depends on the shape of slit 32', and in particular on stepped unit 35's angle of inclination and the shape of the key member engaging unit 29'.

Figure 8:
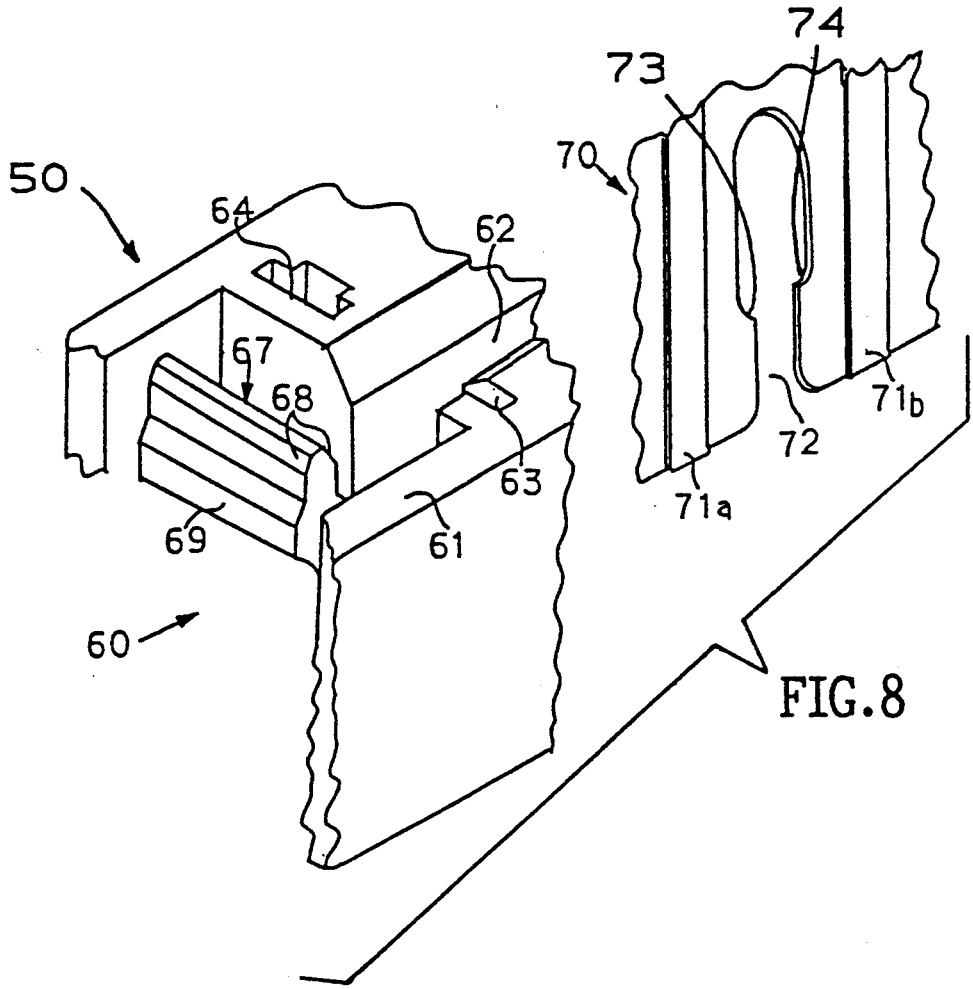
Figure 9:
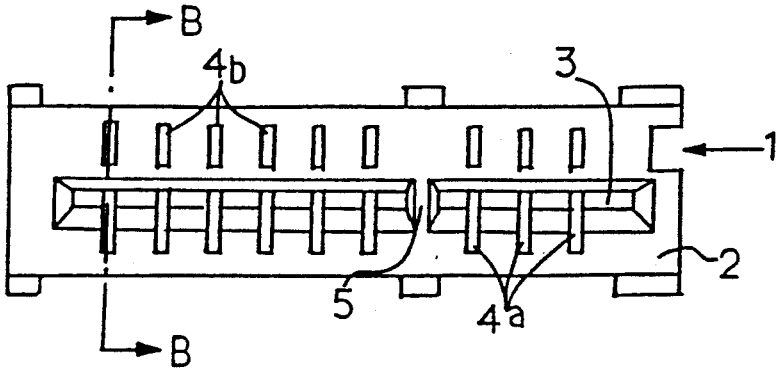
FIG.9 ( PRIOR ART )
FIG. 9 is a view showing a conventional FFC connector.
Figure 10:
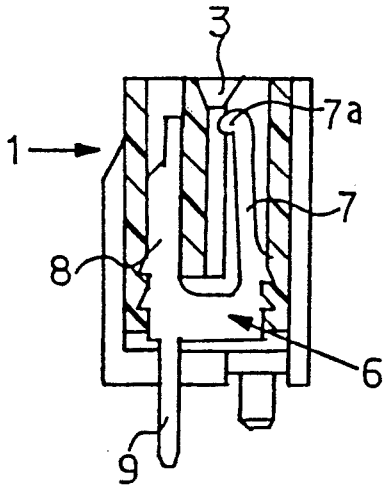
FIG.10 ( PRIOR ART )
FIG. 10 is a cross-sectional view of the connector of FIG. 9 taken along line B—B.
Figure 11:
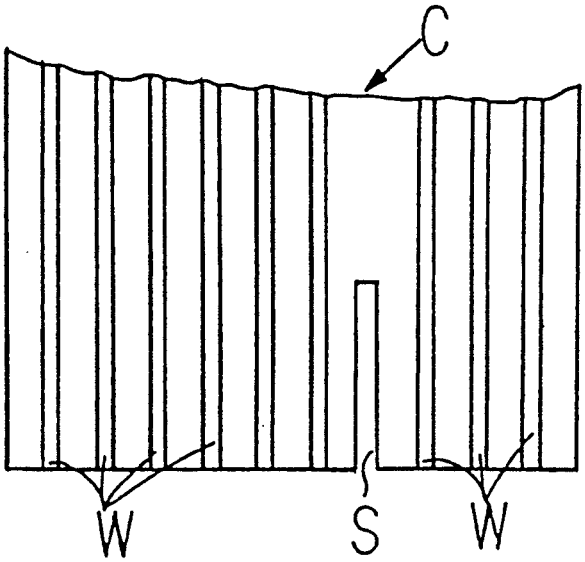
FIG. 11 shows a conventional FFC for use with the connector of FIG. 9.

Another embodiment of this invention's FFC connector is here explained with reference to FIG. 8. FIG. 8 is an oblique view of the key parts of FFC connector 50's insulated housing 50. FIG. 8 includes an oblique view of the key parts of FFC 70, which is used therewith.

This embodiment's FFC connector 50 is suitable when both side walls 73 and 74 of FFC 70's slit 72 are non-linear, i.e., when the entrance narrows and is nearly symmetrical or is offset. FFC connector 50's insulated housing 60's key member 67 has a single-beam shape secured at the bottom so it crosses cable insertion groove 62. Also, a taper is formed on the top of key member 67, to serve as a guide for FFC 70's slit 72. Additionally, engaging unit 69, which projects to the side and has a slanted engaging surface, is formed at the bottom of both sides of key member 67.

Key member 67 and FFC 70's slit 72 have a relative flexibility, even in FFC connector 50, and the engaged and inserted end of FFC 70 is firmly held in FFC connector 50's cable insertion groove 62. Of course, if sufficient tension is applied to FFC 70, FFC 70 is extracted from FFC connector 50's cable insertion groove 62.

This invention's second embodiment FFC connector was explained above, but of course this is not limited to such embodiments. It can undergo various changes and modifications as needed without losing the gist of the invention.

The instant invention's FFC connector provides a slit which has a nonlinear side wall that not only orients the FFC end but also increases the extraction force, and forms and arranges a single-beam-shaped key member which engages with this inside the FFC connector's cable insertion groove. Such a key member is unitarily formed with the insulated housing, so it can be manufactured at low cost. Additionally, the key member itself can be displaced in the cable insertion groove's longitudinal direction, so even if the FFC's slit is non-symmetrical or slightly out of position causing a discrepancy in the friction engaging force, the FFC does not buckle and can be inserted smoothly. Moreover, the extraction force can be increased without greatly increasing the insertion force, so a secure connection can be maintained even when used in portable electronic devices which experience vibration and shock.

I claim:

1. An electrical connector for flat cables comprising:

a connector housing having a longitudinal axis and a plurality of contact receiving sections therein which are spaced along said axis;

each said contact receiving section comprises first and second apertures along a top surface of said connector housing and a contact insertion aperture along a bottom surface of said connector housing, said contact insertion aperture being larger than said first and second apertures for insertion of an electrical contact member at said bottom surface, said top surface further including an elongated cable insertion aperture which transects each said second aperture;

each of said contact receiving sections includes a contact member, said contact member includes, a solder post, a resilient contact arm disposed in each said first aperture, and a holder projection having a through-hole, wherein each said holder projection is disposed in one of said second apertures;

whereby upon insertion of a flat flexible cable the leads thereof engage said contact arms for electrical continuity therewith.

2. The electrical connector of claim 1, wherein said holder projection comprises an arcuate bend across a transverse section thereof.

3. The electrical connector of claim 2, wherein said arcuate bend section has first and second ends which engage a first wall of said second aperture, and an intermediate portion located between said first and second ends which engages a second wall of said second aperture.

4. The electrical connector of claim 3, wherein said bottom surface includes at least one positioning projection formed thereon.

5. The electrical connector of claim 1, wherein a groove is formed between a pair of said contact receiving sections, said groove including a resilient beam formed on a first wall thereof and having a longitudinal axis which extends across said cable insertion groove, said beam comprising a gap formed between an end surface thereof and an second, opposite wall of said groove.

6. The electrical connector of claim 5, wherein said resilient beam deflects in a direction along said contact insertion aperture in response to engagement with said flat flexible cable.

7. The electrical connector of claim 1, wherein at least one notch is formed on an outer surface of said housing and is located outwardly of at least one barb formed on at least one of said contacts.

8. The electrical connector of claim 7, wherein the contacts are of unequal lengths and are alternatively spaced in said housing according to their lengths, wherein a short contact is disposed between two relatively longer contacts.

9. An electrical connector for electrical engagement with a flat electrical conductor, comprising:

a connector housing having an axis and contact receiving sections therein which are spaced along said axis;

each said contact receiving section comprises apertures along a top surface of said connector housing and a contact insertion aperture along a bottom surface of said connector housing, said top surface further including an elongated conductor insertion aperture which transects a first portion of said top surface apertures;

said contact receiving sections include an electrical contact member, said contact member includes a resilient contact arm for electrically engaging said flat conductor, and holding means for retaining the contact member to the housing after the contact members is inserted into the contact insertion aperture;

said connector housing further including a resilient, deflectable beam means joined to said housing at at least one end of the beam for lateral deflection during conductor insertion, and wherein the beam means extends across said elongated conductor insertion aperture;

whereby upon insertion of said flat electrical conductor the resilient beam means deflects around a contour of said conductor for retaining the conductor in the housing.

10. The electrical connector of claim 9, wherein a groove is formed between a pair of said contact receiving sections, said beam means being joined to a wall of said groove, said beam means further comprising a gap formed between a free end of said beam means and an opposing wall of said groove.

11. The electrical connector of claim 9, wherein the beam means has a top surface which faces towards the flat conductor, the top surface of the beam means having a tapered form for ease of deflecting the beam means upon insertion of the flat conductor.

12. An electrical connector for a flat conductor comprising:

a connector housing having an axis and contact receiving sections therein which are spaced along said axis;

said contact receiving sections comprise apertures along a top surface of said connector housing and a contact insertion aperture along another surface of said connector housing, said top surface further including an elongated conductor insertion aperture which transects at least a first portion of said top surface apertures;

said contact receiving sections include electrical contact members, each said contact member includes a resilient contact arm disposed in said first portion of said top surface apertures, at least one of said contact members includes a holder projection having a through-hole, said holder projection forming a closed loop with said through-hole, and wherein each said contact member holder projection is disposed in a second portion of said top surface apertures;

whereby upon insertion of a flat conductor the leads thereof electrically engage said contact arms for electrical continuity therewith.

13. The electrical connector of claim 12, wherein the holder projection has an arcuate bend across a cross-section thereof.

14. The electrical connector of claim 12, wherein a resilient, deflectable beam means is formed on said housing, the beam means extending across said elongated conductor insertion aperture, said beam means retains said conductor when said conductor is in the inserted position.

* * * * *